US006347637B1

(12) United States Patent
Musha et al.

(10) Patent No.: US 6,347,637 B1
(45) Date of Patent: Feb. 19, 2002

(54) CLEANING METHOD OF CONTAINERS AND APPARATUS THEREOF

(75) Inventors: Takanori Musha; Shirushi Yamamoto; Takashi Takeda, all of Shizuoka (JP)

(73) Assignee: Clariant International Ltd., Muttenz (CH)

( * ) Notice: Subject to any disclaimer, the term of this patent is extended or adjusted under 35 U.S.C. 154(b) by 0 days.

(21) Appl. No.: 09/346,428

(22) Filed: Jul. 1, 1999

(30) Foreign Application Priority Data

Jul. 3, 1997 (JP) ..... 10-189339

(51) Int. Cl.[7] ..... B08B 3/02

(52) U.S. Cl. ..... 134/64 R; 134/72; 134/122 R; 134/131

(58) Field of Search ..... 134/131, 64 R, 134/122 R, 72, 201, 200

(56) References Cited

U.S. PATENT DOCUMENTS 1,943,775 A * 1/1934 Taylor
2,766,764 A * 10/1956 Bennett
3,756,898 A * 9/1973 Frantzen et al.
4,073,663 A * 2/1978 Lundgren
4,076,554 A * 2/1978 Weihe
4,291,500 A * 9/1981 Reckin et al.
4,805,649 A * 2/1989 Nezworski
5,313,965 A * 5/1994 Palen

* cited by examiner

*Primary Examiner*—Frankie L. Stinson
(74) *Attorney, Agent, or Firm*—Krishna Banerjee

(57) ABSTRACT

A container cleaning apparatus comprises a solvent cleaning unit having a solvent cleaning chamber, and a rinsing unit having a rinsing chamber connected to the solvent cleaning chamber. Containers are conveyed by a conveyor through the solvent cleaning chamber and the rinsing chamber. The containers are cleaned by jetting a water-soluble or partially water-soluble solvent against the containers in the solvent cleaning chamber. Shutter devices have shutters disposed at an entrance to the solvent cleaning chamber and an exit from the solvent cleaning chamber, respectively, and capable of being moved between closed positions to close the entrance to and the exit from the solvent cleaning chamber and to isolate the solvent cleaning chamber from the rinsing chamber, and open positions to permit the containers to move from the solvent cleaning chamber to the rinsing chamber. During a solvent cleaning process for cleaning the containers with the solvent in the solvent cleaning chamber, the solvent cleaning chamber is isolated from the external space so that the solvent may not leak outside.

1 Claim, 9 Drawing Sheets

CLEANING METHOD OF CONTAINERS AND APPARATUS THEREOF

BACKGROUND OF THE INVENTION

1. Field of the Invention

The present invention relates to a method of cleaning a container, such as a can for containing a resist, and a cleaning apparatus for carrying out the method.

2. Description of the Related Art

A resist to be applied to LCD substrates is delivered to the user in a can called a NOWPAK (trade name). A pack of a resist is prepared by filling a container lined with a liner, and attaching a cap, a closure and a dip tube to the container. The pack of the resist is delivered from a production company to a user. After the resist contained in the container has been consumed, the pack is returned from the user to the production company. The production company extracts the liner from the empty container, disposes of the extracted liner, cleans the container, the cap, the closure and the diptube, lines the cleaned container with a new liner, fills up the container with the resist, attaches the cap, the closure and the dip tube to the container to complete a pack, and then sends the pack containing the resist to the user.

A conventional method of cleaning the used container to reuse the same comprises the steps of cleaning the container with a solvent by hand, rinsing the container with water, and drying the container. A solvent, such as acetone, methyl ethyl ketone or an alcohol, is used for solvent cleaning. Such a solvent, however, has a low flash point and a danger of ignition and explosion. The respective flash points of acetone, methyl ethyl ketone and alcohols are −18° C., −7° C. and in the range of 12 to 14° C. Since those solvents are highly volatile, evaporate easily and have irritating smells, operators using those solvents need to wear personal protective equipment, such as a gas mask. Furthermore, those solvents are detrimental to health, and there are problems in working in an environment using those solvents.

SUMMARY OF THE INVENTION

Accordingly, it is an object of the present invention to obviate manual solvent cleaning work and to enable the automatic solvent cleaning of containers.

Another object of the present invention is to provide a container cleaning method capable of automatically carrying out a solvent cleaning process and a rinsing process.

A further object of the present invention is to provide a cleaning apparatus capable of automatically carrying out a container cleaning method comprising a solvent cleaning process and a rinsing process.

According to one aspect of the present invention, a container cleaning method uses a water-soluble or partially water-soluble solvent having a relatively high flash point of 55° C. or above instead of a solvent having a low flash point. The container cleaning method comprises the steps of cleaning containers with a water-soluble or partially water-soluble solvent having a relatively high flash point of 55° C. or above by jetting the solvent against the containers in a cleaning chamber formed in a solvent cleaning vessel, transferring the containers cleaned with the solvent to a rinsing chamber formed in a rinsing vessel, and jetting a rinsing liquid against the containers in the rinsing chamber.

According to another aspect of the present invention, a container cleaning apparatus comprises: a solvent cleaning unit having a solvent cleaning chamber internally provided with solvent jetting means for jetting a water-soluble or partially water-soluble solvent; a rinsing unit having a rinsing chamber connected to the solvent cleaning chamber and internally provided with rinsing liquid jetting means; a conveyor extended through the solvent cleaning chamber and the rinsing chamber; a container support device provided on the conveyor to be conveyed thereby for supporting containers thereon so that the containers can be cleaned with the water-soluble or partially water-soluble solvent jetted by the solvent jetting means and can be rinsed with the rinsing liquid jetted by the ringing liquid jetting means; and shutting devices having shutters capable of being moved between closed positions to close an entrance to the solvent cleaning chamber and to isolate the solvent cleaning chamber from the rinsing chamber, and open positions to permit the container support device and the containers supported on the container support device to move from the solvent cleaning chamber to the rinsing chamber.

The above and other objects, features and advantages of the present invention will become more apparent from the following description taken in connection with the accompanying drawings.

DESCRIPTION OF THE PREFERRED EMBODIMENTS

Figure 1:
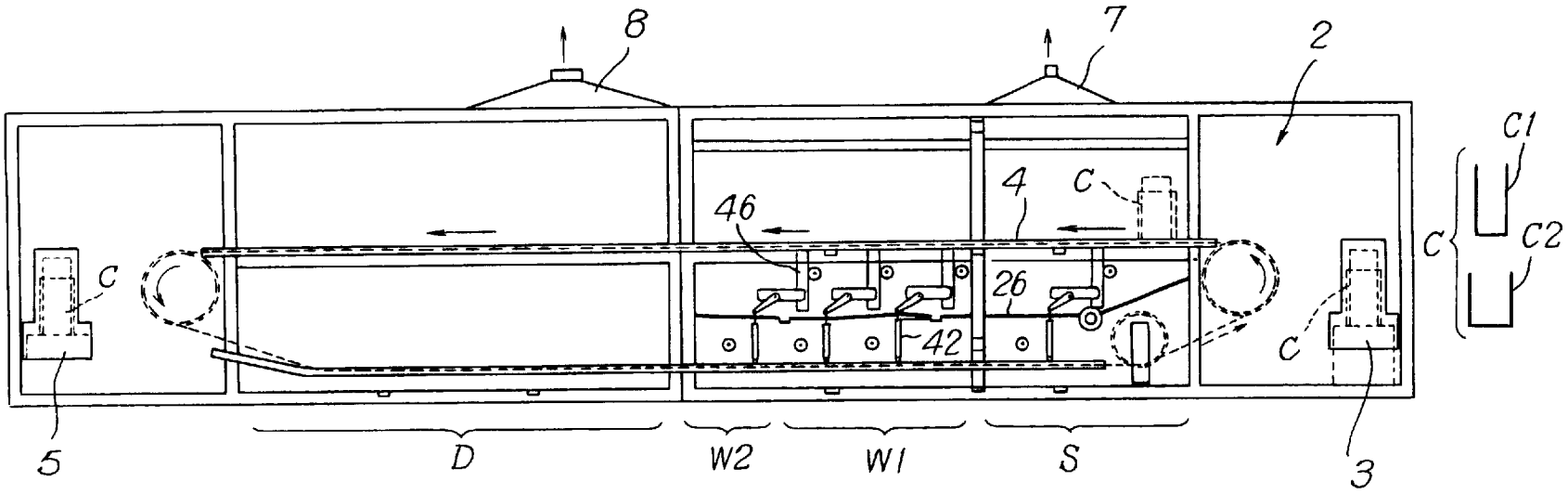
FIG. 1 is a front elevation of a container cleaning apparatus in a preferred embodiment of the present invention.

In the following description, words signifying directions, positions and such are used for signifying directions, positions and such as viewed in the drawings.

Referring to FIG. 1, a container cleaning apparatus in a preferred embodiment of the present invention has a shape substantially resembling a rectangular parallelepiped. Basically, the interior of the housing 2 is isolated from the atmosphere. The container cleaning apparatus is capable of cleaning two kinds of containers C1 and C2 respectively having different sizes. Typically, the containers C1 and C2 are those known by the trade name of 'NOWPAK can'. The container C1 is tall and has a small diameter, and the container C2 is short and has a great diameter. Although the two kinds of containers C1 and C2 are cleaned individually, both the containers C1 and C2 are shown in a superposed view and are designated inclusively by a reference character C in the drawings illustrating the present invention. During a cleaning process, the container C is supported in an inverted position with its bottom facing upward and its open end facing downward.

Container C are fed into the housing 2 through the right end of the housing 2, are conveyed leftward intermittently, and are sent out through the left end of the housing 2. A solvent cleaning unit S, a city water rinsing unit W1, a pure water rinsing unit W2 and a drying unit D are arranged sequentially in that order from the right toward the left in the housing 2. The adjacent units S and W1, the adjacent units W1 and W2, and the adjacent units W2 and D are isolated from each other. Containers C to be cleaned are delivered to and placed on a container receiving device 3 with their open ends facing upward, the containers C are inverted and transferred to a conveyor 4 in an inverted position. The conveyor 4 carries the containers C leftward as indicated by the arrow. The solvent cleaning unit S jets a solvent against the containers C for solvent cleaning. Then, the city water rinsing unit W1 jets city water against the containers C for city water rinsing. The pure water rinsing unit W2 jets pure water against the containers C for pure water rinsing. Finally, the drying unit D dries the containers C. The clean containers C thus cleaned and dried are delivered to and placed on a container delivering device 5. The container delivering device 5 takes the clean containers C outside the housing 2. A solvent recovering hood 7 for recovering the evaporated solvent is disposed on top of the solvent cleaning unit S. A ventilation hood 8 for exhausting steam produced in the drying unit D is disposed on top of the drying unit D.

Figure 2:
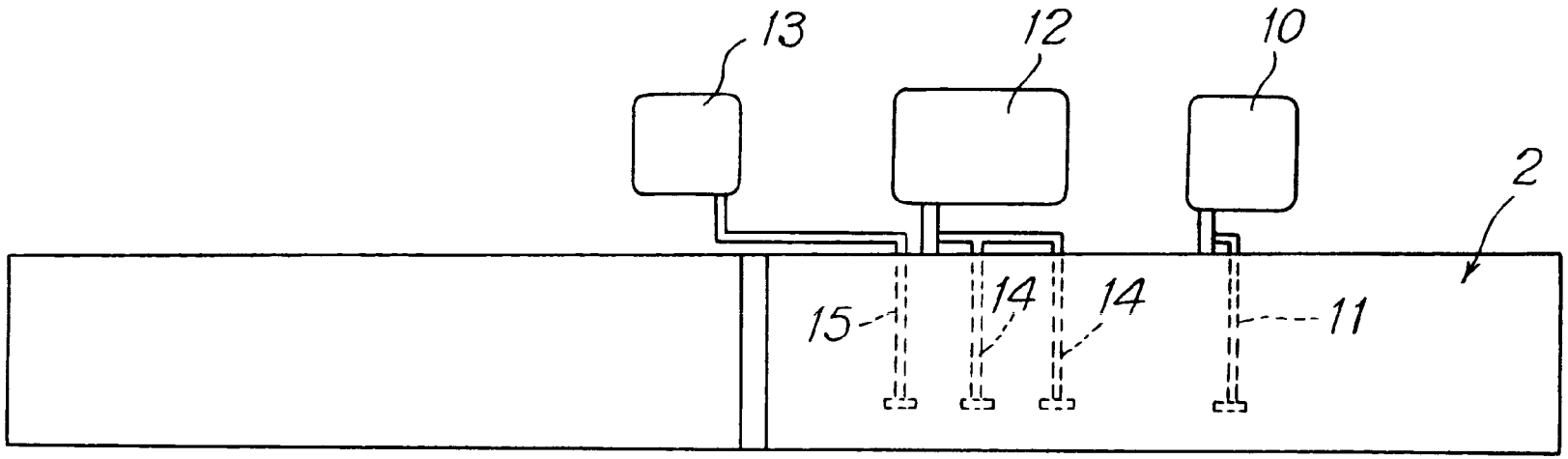
FIG. 2 is a plan view of the container cleaning apparatus shown in FIG. 1.

Referring to FIG. 2 showing the container cleaning apparatus in plan view, a solvent tank 10 is disposed on one side of the housing 2. The solvent contained in the solvent tank 10 is supplied through a pipe 11 laid in the housing 2 to a solvent jetting device, which will be described later. A city water tank 12 containing city water and a pure water tank 13 containing pure water are disposed on the same side of the housing 2. The city water tank 12 and the pure water tank 13 supply the city water and the pure water through pipes 14 and 15 laid in the housing 2 to a city water jetting device, not shown, and a pure water jetting device, not shown, respectively.

Figure 3:
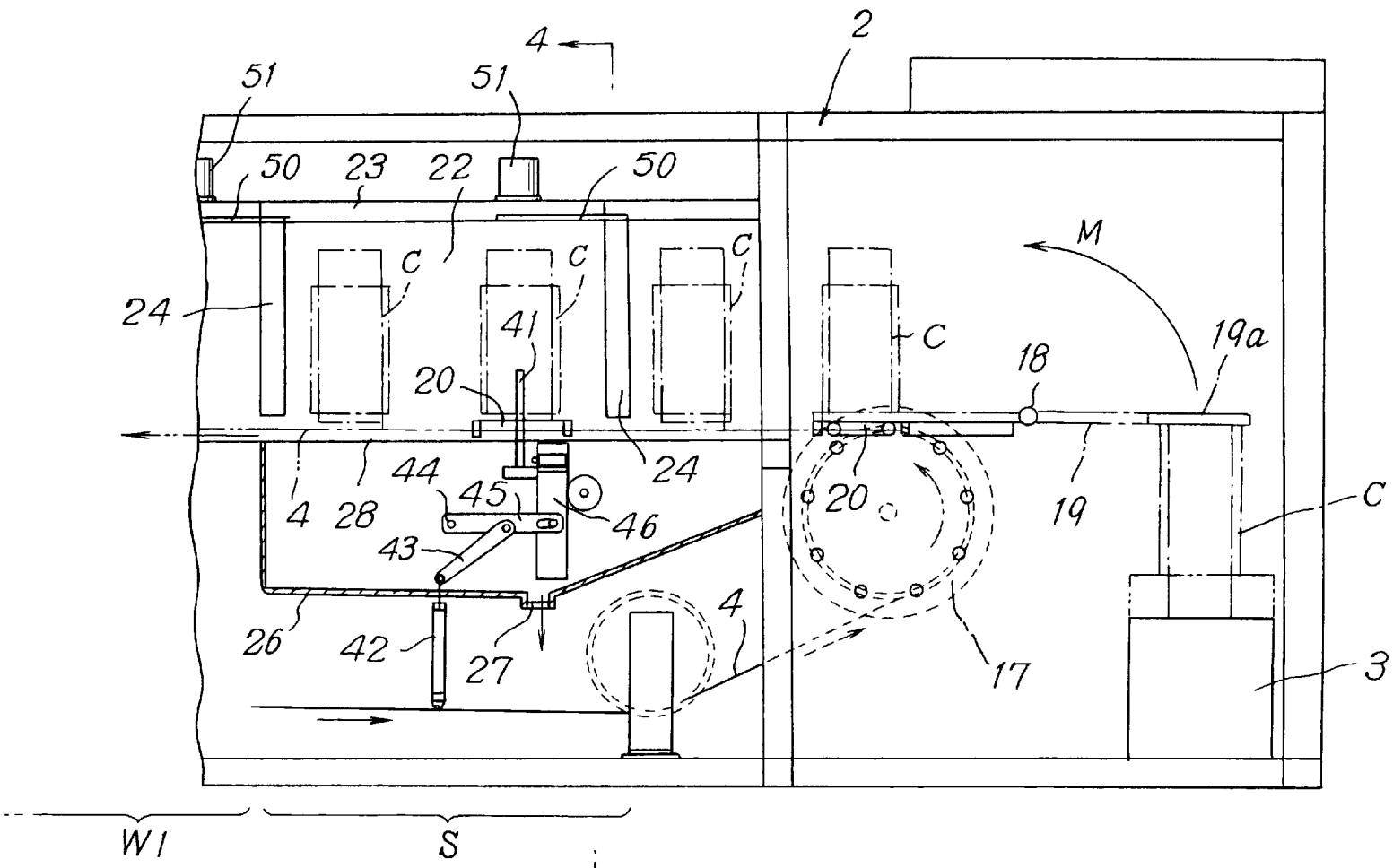
FIG. 3 is an enlarged front elevation of a right end section, as viewed in FIG. 1, of the container cleaning apparatus shown in FIG. 1.

FIG. 3 shows a right end section of the container cleaning apparatus shown in FIG. 1 in an enlarged view. The conveyor 4 has a pair of endless chains wound around sprockets 17. The endless chains are moved intermittently in the direction of the arrow. Containers C placed on the container receiving device 3 is transferred to and mounted in an inverted position on a container support device 20 supported on the conveyor 4 by a transfer arm 19. The transfer arm 19 has one end supported on a horizontal shaft 18 for turning in a vertical plane, and a holding part 19*a* for holding containers C. The conveyor 4 is driven to convey the containers C leftward. The container support device 20 will be described later.

As shown in FIG. 3, the solvent cleaning unitS has a solvent cleaning chamber 22. The solvent cleaning chamber 22 is defined by a top wall 23, front and back shutters 24 and side walls of the housing 2. Basically, the cleaning chamber 22 is isolated from the space outside the housing 2 The pure water cleaning unit W2 and the drying unit D are separated by shutters 24 similar to the shutters 24 of the water cleaning unit W1. The bottom of the solvent cleaning chamber 22 is covered with a solvent sink 26. The solvent jetted against the containers C in the solvent cleaning chamber 22 drops into and collected in the solvent sink 26. The solvent collected in the solvent sink 26 is drained through a drain port 27 and the solvent thus recovered is used again for solvent cleaning. A solvent recovering system will be described later. The pair of chains of the conveyor 4 are guided for movement toward the left in the solvent cleaning chamber 22 by parallel chain guides 28 having the shape of a trough and extended in parallel to each other on the opposite sides of the cleaning chamber 22 as shown in FIG. 4.

Figure 4:
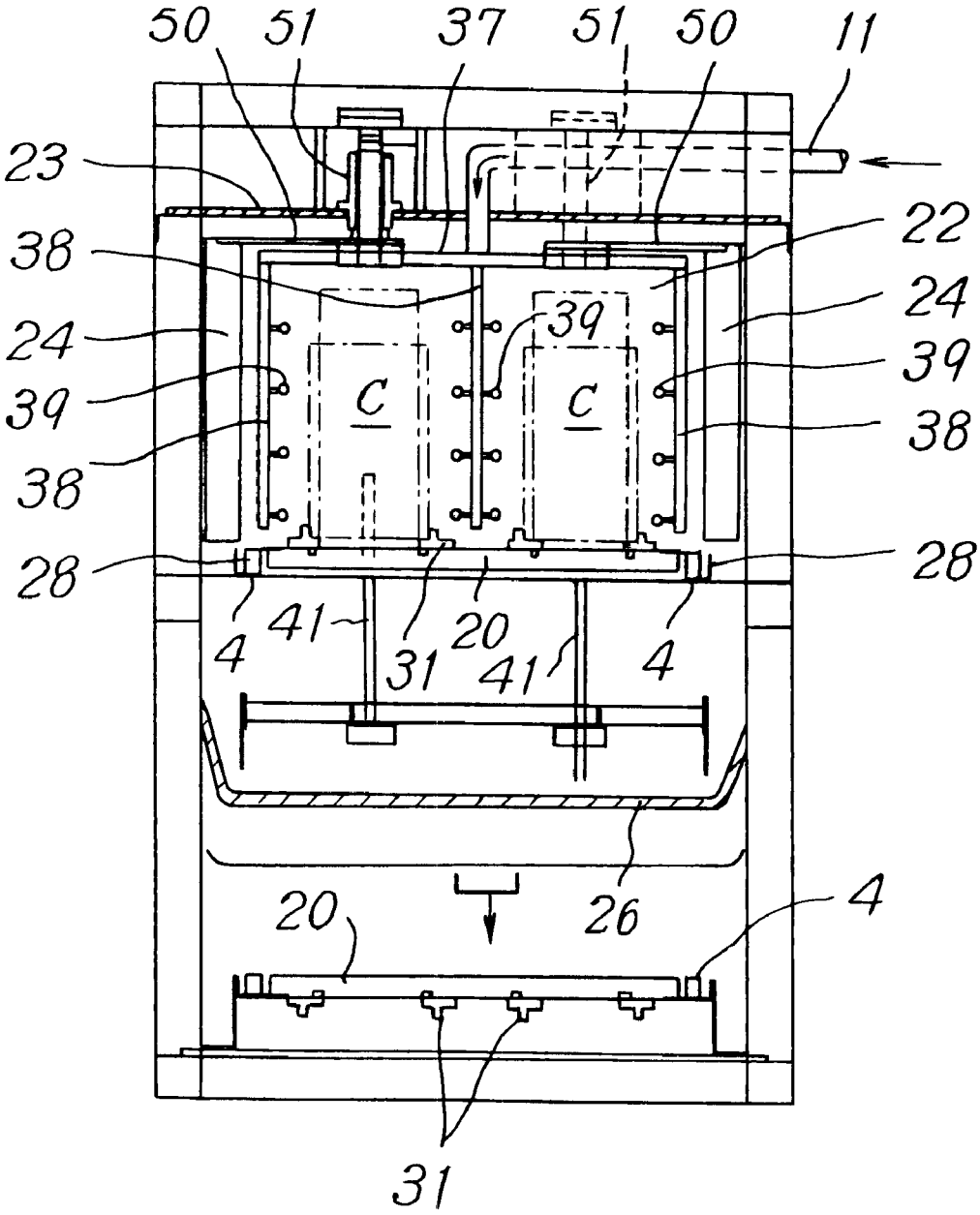
FIG. 4 is a sectional view taken on line 4—4 in FIG. 3.

As best shown in FIG. 4, the containers C are conveyed in two rows. The container support device 20 is supported on the pair of parallel chains of the conveyor 4, and supports a pair of containers C thereon.

Figure 5:
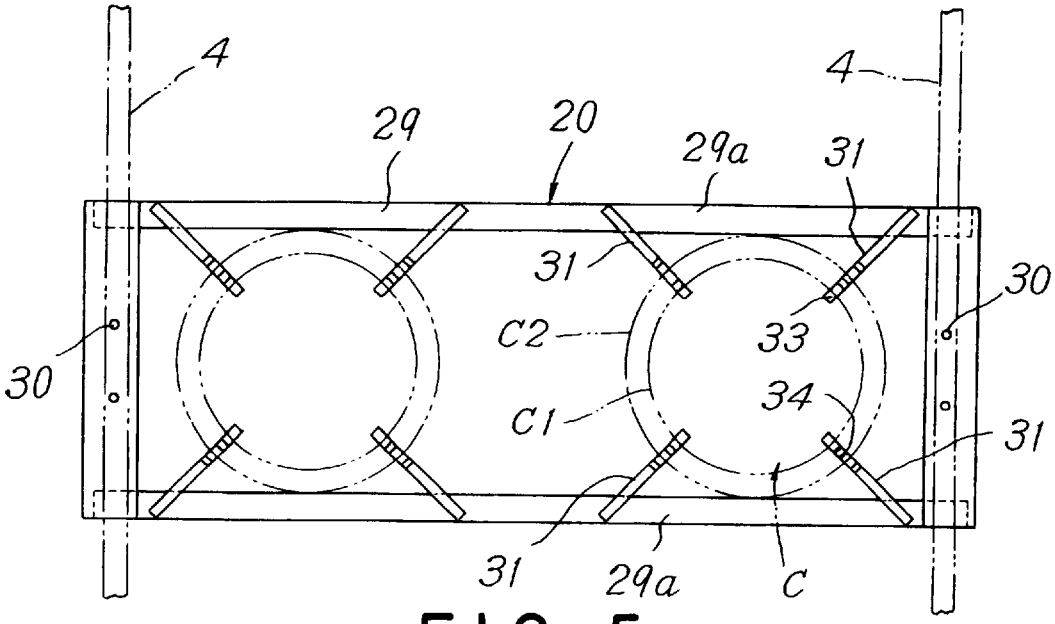
FIG. 5 is a plan view of a container support device.
Figure 6:
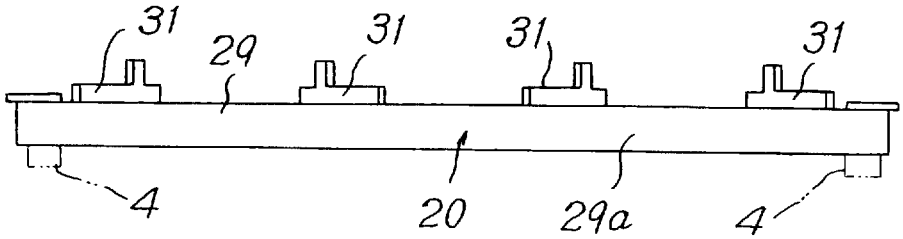
FIG. 6 is a side elevation of the container support device shown in FIG. 5.
Figure 7:
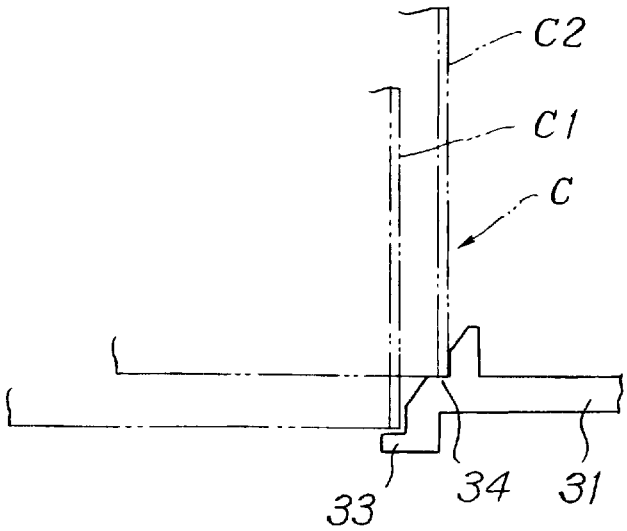
FIG. 7 is a view of assistance in explaining a container supporting bar included in the container support device shown in FIG. 5.

Referring to FIGS. 5 to 7, each container support device 20 has a rectangular support frame 29 extended between and fastened with bolts to the chains. The support frame 29 moves together with the chains. The support frame 29 has opposite cross beams 29*a*. Two sets of container support bars 31 are extended obliquely inward from the cross beams 29*a* in a radial arrangement as shown in FIG. 5. Each of the container support bars 31 has an outer end part fastened to the cross beam 29*a*, and an inner end part provided with a first support step 33 to support a container C1 of a small diameter and a second support step 34 to support a container C2 of a great diameter as shown in FIG. 7. Thus, either a container C1 or a container C2 can be supported on the set of four container support bars 31 as shown in FIG. 5. Containers C are placed in an inverted position on the sets of container support bars 31 by the transfer lever 19 shown in FIG. 3.

Containers C supported on the container support device 20 in two rows as shown in FIG. 4 are sent into and stopped in the solvent cleaning chamber 22. Then, the solvent is jetted against the outer surfaces of the containers C by a solvent jetting device. Referring to FIG. 4, the solvent jetting device has the solvent supply pipe 11 connected to the solvent tank 10 (FIG. 2), horizontal distributing pipes 37 connected to the solvent supply pipe 11, vertical nozzle pipes 38 connected to the distributing pipes 37, respectively, extended along the side wall of the containers C and provided with nozzles 39 directed toward the side walls of the containers C. The nozzle pipes 38 are arranged so as to jet the solvent from four directions against the outer circumference of each container C. The solvent is jetted against the outer surface of the containers C to clean the same.

Referring to FIG. 3, solvent jetting pipes 41 are disposed in an upright attitude so as to correspond to the containers C located at cleaning positions, respectively. Each solvent jetting pipe 41 is provided in its end wall and side wall with solvent jetting holes to jet the solvent upward and radially into the container C supported in an inverted attitude on the container support device 20. The solvent jetting pipes 41 are connected to the solvent tank 10 (FIG. 2).

The operating rod of an air cylinder actuator 42 is extended upward to raise a link 43 pivotally connected to a lever 45. Consequently, the lever 45 is turned counter clock wise on a fixed shaft 44 to raise a sliding member 45, so that the upright solvent jetting pipes 41 are raised through the open ends of the container C into the container C. Then, the solvent is jetted upward and radially through the solvent jetting holes of the solvent jetting pipes 41 against the inner surfaces of the container C to clean the inner surfaces of the container C. After the inner surfaces of the containers C have been cleaned, the operating rod of the air cylinder actuator 42 is retracted to lower the solvent jetting pipes 41. The solvent jetted against the outer and the inner surfaces of the container C drops and collected in the solvent sink 26. Then, the solvent drained through the drain port 27 and is recovered. In FIG. 4, the left solvent jetting pipe 41 is at a working position in the container C, and the right solvent jetting pipe 41 is at a waiting position outside the container C.

The solvent cleaning chamber 22 must be isolated from the external space while the containers C are being cleaned in the solvent cleaning chamber 22 to prevent the leakage of the jetted solvent outside the solvent cleaning chamber 22. Therefore, as mentioned previously with reference to FIG. 3, the shutters 24 are disposed at the entrance to the solvent cleaning chamber 22 and the exit from the same connected to the city water cleaning chamber W1. The shutter 24 at the entrance to the solvent cleaning chamber 22 must be moved to a position where the shutter 24 will not obstruct the feed of the containers C into the solvent cleaning unit S, and the shutter 24 at the exit from the solvent cleaning chamber 22 must be moved to a position where the shutter will not obstruct the transfer of the container C from the solvent cleaning unit S to the city water cleaning unit W1.

Figure 9:
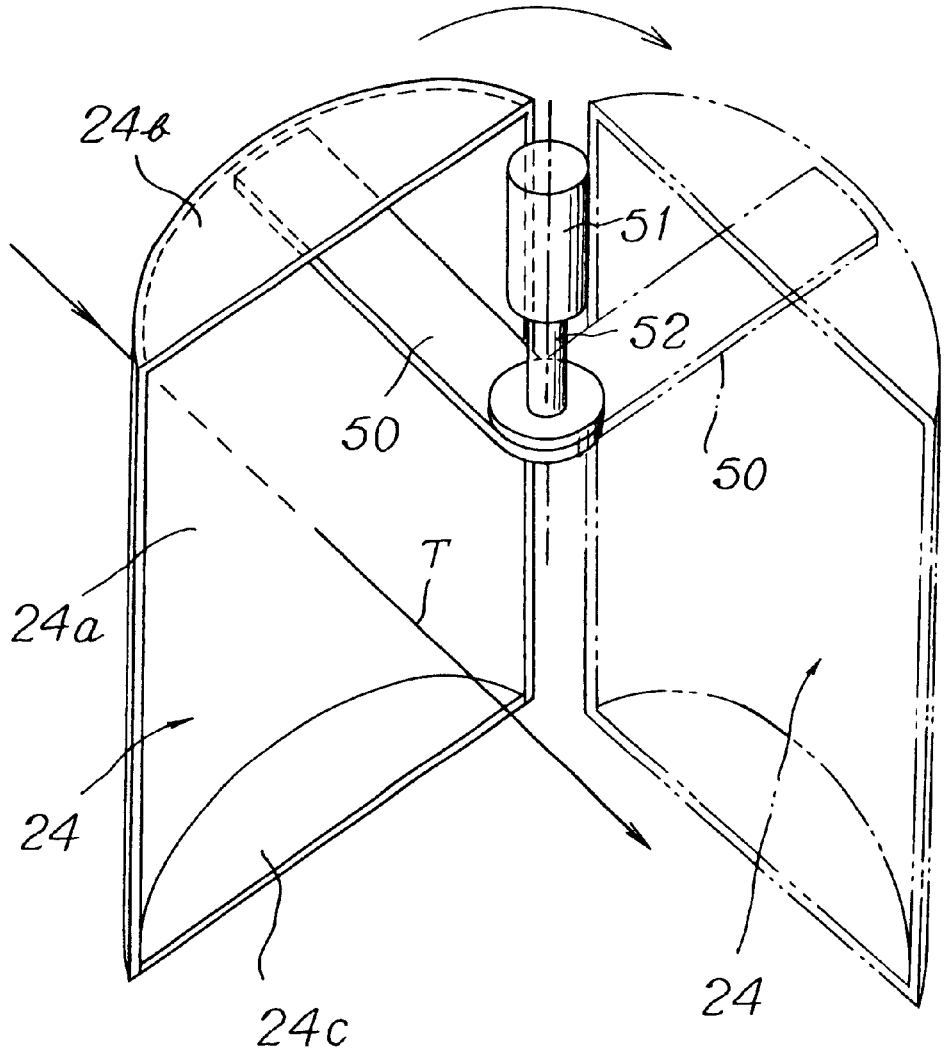
FIG. 9 is a perspective view of a shutting device.

A shutter moving mechanism for moving the shutter 24 between a closed position shown in FIG. 3 and a open position away from the position shown in FIG. 3 will be described hereafter. Referring to FIG. 9, the shutter 24 comprises a body 24*a* having a cross section substantially resembling a segment of a circle, a top plate 24*b* welded to the upper end of the body 24*a*, a bottom plate 24*c* welded to the lower end of the lower end of the body 24*a*. One end part of a swing arm 50 is fixed to a middle part of the top plate 24*b* so as to extend toward the center of a circle including the outer circular surface of the body 24*a*, and the other end part of the swing arm 50 is fastened to the drive shaft 52 of a rotary actuator 51. The actuator 51 turns the shutter 24 between the closed position indicated by continuous lines in FIG. 9 and a open position indicated by imaginary lines in FIG. 9. When set at the closed position, the shutter 24 extends across the direction of the arrow T (FIG. 9) to shut the solvent cleaning chamber 22. When set at the open position indicated by the imaginary lines, the shutter 24 is moved away from a container conveying passage to permit the containers C to be moved along the container conveying passage.

Figure 8:
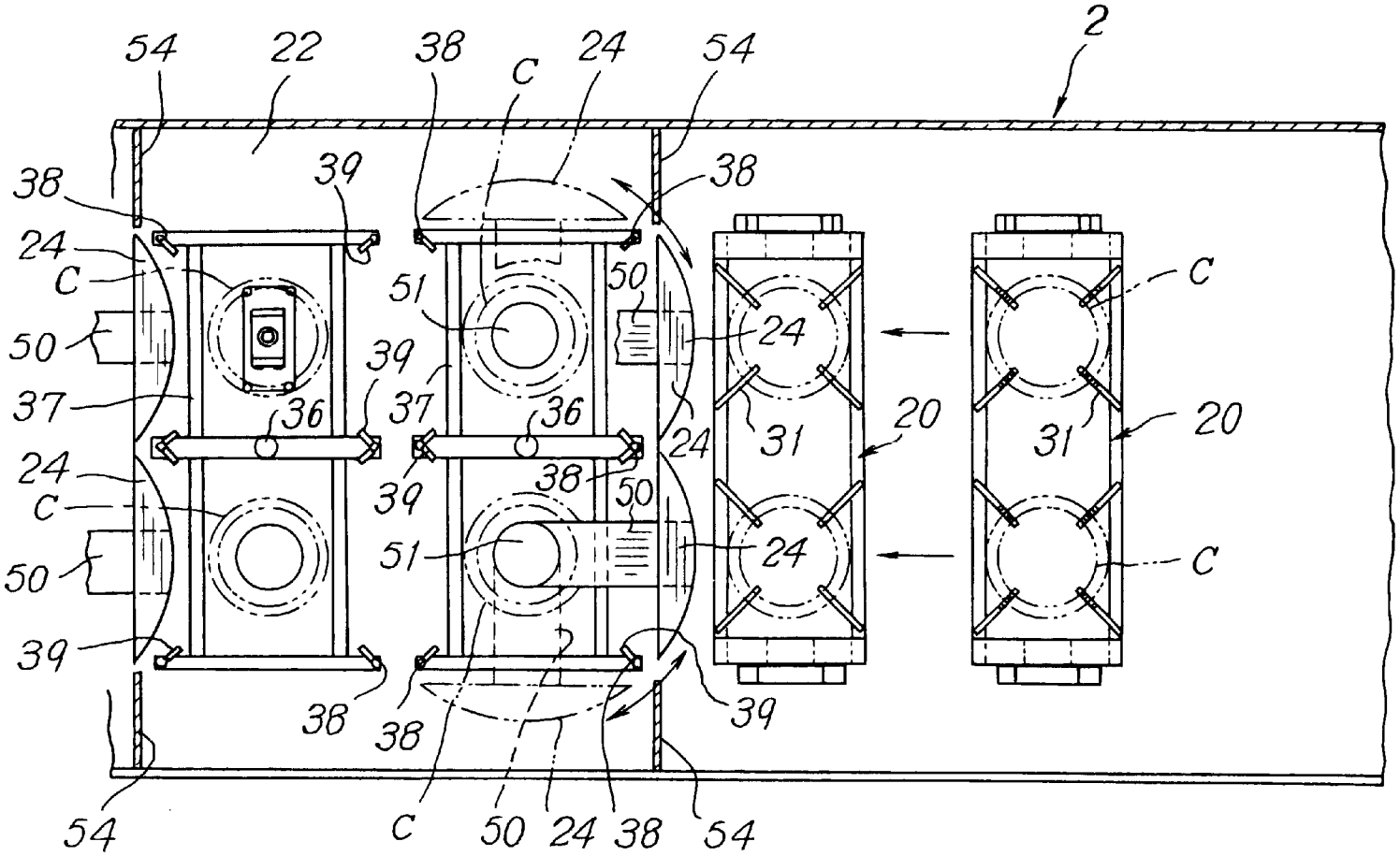
FIG. 8 is a plan view of the right end section of the container cleaning apparatus shown in FIG. 3.

The positional relation between the shutters 24 and the solvent cleaning chamber 22 is illustrated in FIGS. 3, 4 and 8. In a state shown in FIG. 3, the entrance to the solvent cleaning chamber 22 and the exit from the solvent cleaning chamber 22, i.e., the boundary between the solvent cleaning unit S and the city water rinsing unit W1, are closed by the shutters 24. In the state shown in FIG. 4, the shutters 24 are turned to their open positions on the outer sides of the containers C by the rotary actuators 51, respectively. In FIG. 8, the shutters 24 at their closed positions are indicated by continuous lines and those at their open positions are indicated by imaginary lines. When the shutters 24 are turned to the closed positions indicated by continuous lines, the outer side edges of the shutters 24 are close to the edges of a partition walls 54 (FIG. 8) to keep the solvent cleaning chamber 22 closed. Since the outer surface of each shutter 24 is a part of a circular cylinder having a center axis coinciding with the center axis of the drive shaft 52 (FIG. 9), a fixed, small clearance is maintained between the outer surface of the shutter 24 and the partition wall 54 when the shutter 24 is turned between the open position and the closed position. The rotary actuators 51 are disposed with the center axes of the drive shafts 52 aligned with the center axes of the containers C as located at cleaning positions, respectively.

Figure 10:
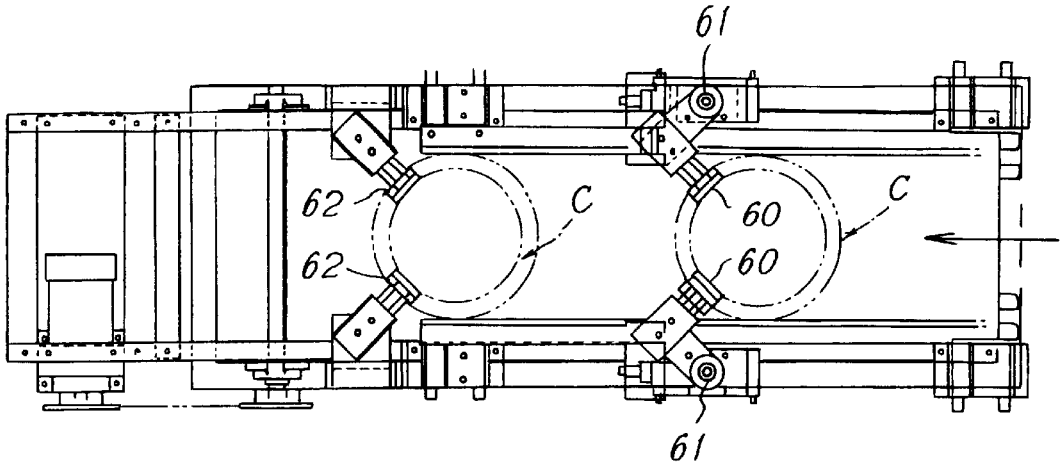
FIG. 10 is a plan view of a section of the container cleaning apparatus shown in FIG. 1, explaining a container sensor for positioning a container.
Figure 11:
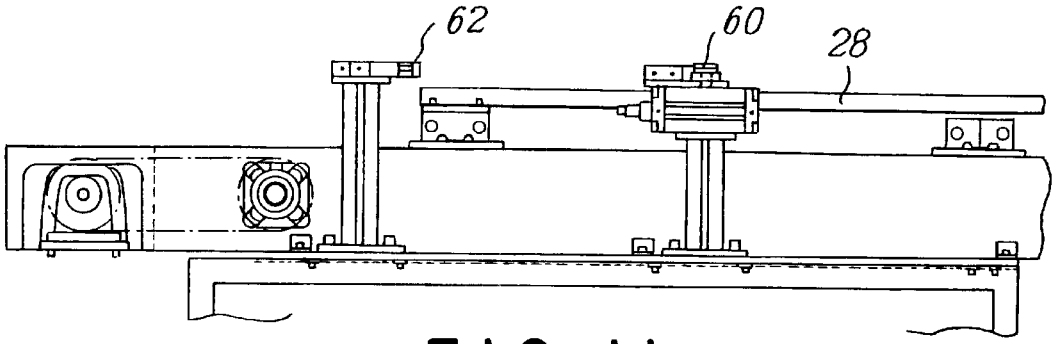
FIG. 11 is a side elevation of the section shown in FIG. 10.
Figure 12:
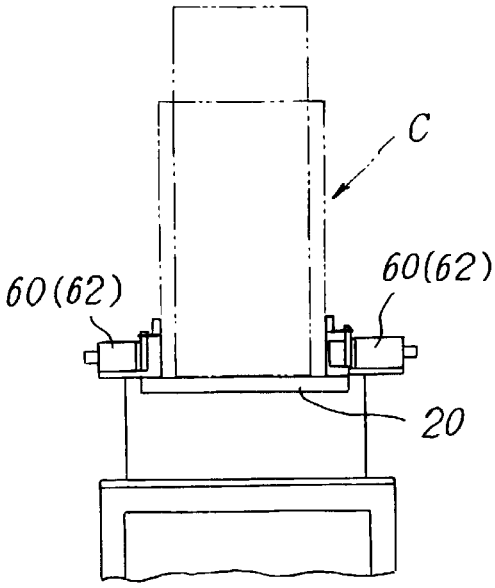
FIG. 12 is a view of assistance in explaining the relation between the container sensor and a container.

FIGS. 10 to 12 show container detectors for detecting the containers C before the containers C are fed into the solvent cleaning unit S to feed intermittently the containers C supported on the container support device 20 extended between the chains of the conveyor 4. Referring to FIG. 10, when the container C is fed from the right toward the left as indicated by the arrow and the container C arrives at a position indicated by imaginary lines, the container C collides with two movable container detectors 60 disposed on the opposite sides, respectively, of a container carrying passage and is kept stationary. The movable container detectors 60 are turned outward on shafts 61 and are moved away from the passage of the container C when the container C is moved further leftward. Stationary container detectors 62 are disposed on the left side of the movable container detectors 60. As shown in FIGS. 11 and 12, the container detectors 60 and 62 are disposed on a level corresponding to a lower open end part of the container C.

Basically, the city water rinsing unit W1 and the pure water rinsing unit W2 disposed downstream of the solvent cleaning unit S are similar in construction to the solvent cleaning unit S, and differ from the solvent cleaning unit S in that the city water rinsing unit W1 and the pure water rinsing unit W2 use city water and pure water, respectively, instead of the solvent. The city water rinsing unit W1 and the pure water rinsing unit W2 are the same in construction and function as the conventional rinsing units and hence further description thereof will be omitted. The drying unit D subsequent to the pure water rinsing unit W2 blows hot air heated by steam against the containers C to evaporate water remaining on the containers C for drying.

Figure 13:
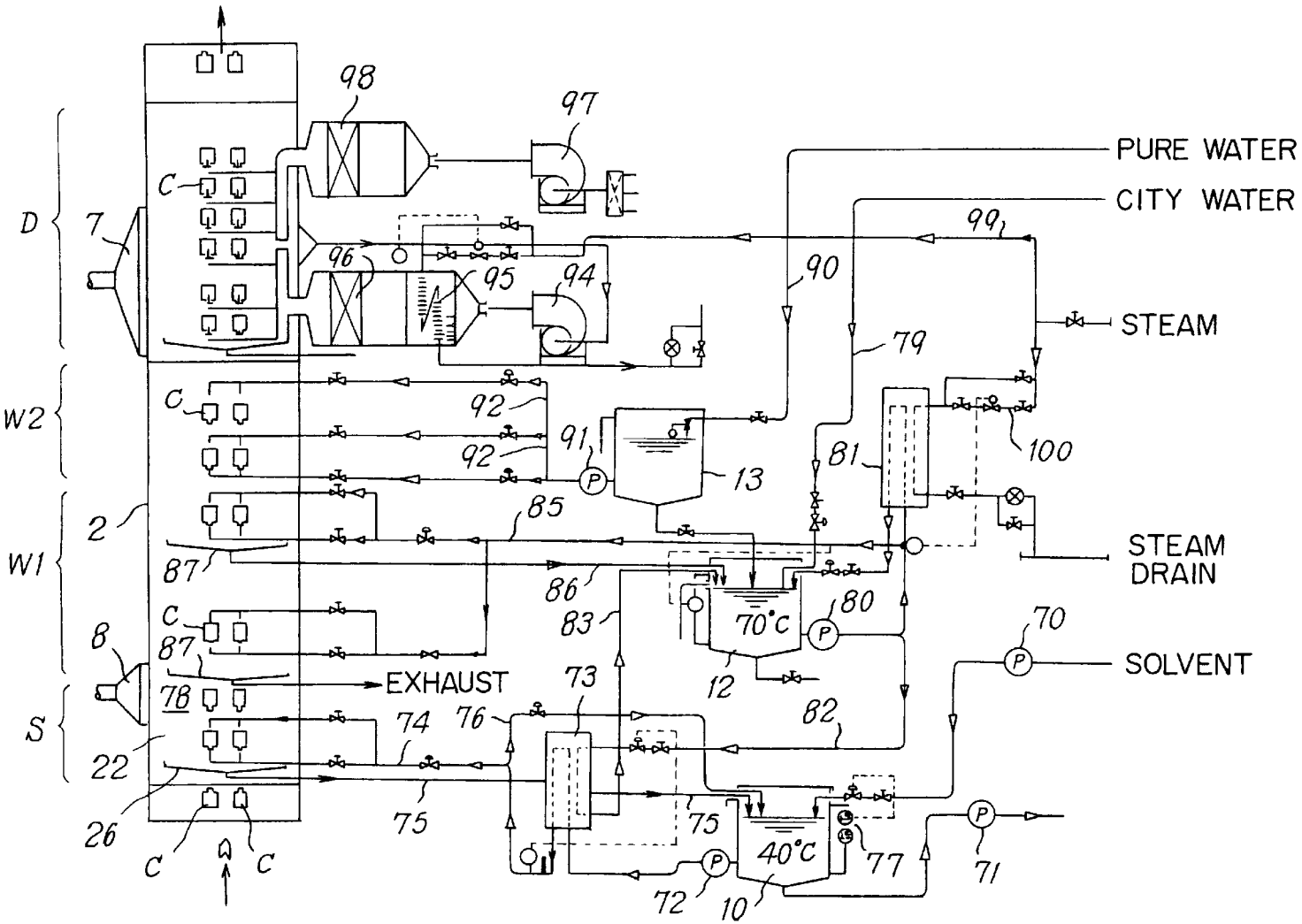
FIG. 13 is a piping diagram of a piping system included in the container cleaning apparatus shown in FIG. 1.

FIG. 13 is a piping diagram of a piping system included in the container cleaning apparatus shown in FIG. 1. In FIG. 13, the solvent cleaning unit S, the city water rinsing unit W1, the pure water rinsing unit W2 and the drying unit D are arranged in the housing 2 upward from below in that order as viewed in FIG. 13. Containers C are conveyed upward as viewed in FIG. 13 through the housing 2. The solvent tank 10 is at the lower right part of FIG. 13. The city water tank 12 and the pure water tank 13 are above the solvent tank 10 as viewed in FIG. 13. A solvent supply pump 70 supplies the solvent into the solvent tank 10. When necessary, a drain pump 71 pumps the solvent from the solvent tank 10 for disposal. A solvent feed pump 72 sends the solvent from the solvent tank 10 into a heat exchanger 73. The solvent heated at a predetermined temperature by the heat exchanger 73 flows through a line 74 and is jetted against containers C in the solvent cleaning chamber 22 for cleaning. The solvent jetted in the solvent cleaning chamber 22 is collected in the solvent sink 26 and is returned through a line 75 into the solvent tank 10. Part of the solvent delivered from the heat exchanger 73 can be returned through a line 76 into the solvent tank 10. In the solvent tank 10, the solvent is kept at about 40° C. or above. The level of the surface of the solvent in the solvent tank 10 is kept constant. The solvent circulating through a solvent circulating system is replaced gradually with new solvent by supplying the new solvent into the solvent circulating system so as to maintain the constant level of the surface of the solvent in the solvent tank, by pumping out the solvent from the solvent tank 10 by the drain pump 71 and by replenishing the solvent circulating system with the new solvent. Accordingly, the solvent circulating system need not be provided with any filter for filtering the solvent. The solvent remaining on the containers C is dripped at a solvent dripping position 78.

Fresh city water is supplied through a line 79 into the city water tank 12. The surface of the city water contained in the city water tank 12 is kept at a fixed level. Part of the city water contained in the city water tank 12 is pumped up by a pump 80 into a heat exchanger 81. The heat exchanger 81 transfers heat from steam to the city water to heat the city water and returns the heated city water into the city water tank 12 to maintain the city water contained in the city water tank 12 at, for example, about 70° C. The city water heated at about 70° C. is pumped by the pump 80 through a line 82 into the heat exchanger 73 to heat the solvent. The city water is returned from the heat exchanger 73 through a line 83 to the city water tank 12. Part of the city water pumped by the pump 80 toward the heat exchanger 81 is supplied through a line 85 connected to a line connected to the heat exchanger 81 to the rinsing chamber of the city water rinsing unit W1 to rinse the outer and inner surfaces of the containers C. The city water used for rinsing the containers C is collected in a sink 87 and is returned through a line 86 into the city water tank 12.

Pure water is supplied through a line 90 into the pure water tank 13. The pure water contained in the pure water tank 13 is not heated. A pump 91 pumps the pure water at room temperature from the pure water tank 13 and sends the pure water through a line 92 to the pure water rinsing unit W2 to jet the pure water against the containers C rinsed with city water. All the pure water used for pure water rinsing is sent to the city water tank 12 to use the same for city water rinsing.

Air blown by a blower 94 flows through a heater 95. The heater heats the air, and the heated air is filtered by a filter 96 and flows into the drying unit D to dry the cleaned and rinsed containers C. Cool air blown by a blower 97 is filtered by a filter 98, and the containers C are cooled to a temperature nearly equal to room temperature by the filtered cool air. Steam is supplied through a line 99 to the heater 95, and through a line 100 to the heat exchanger 81 for heating city water.

The operation of the container cleaning apparatus and a container cleaning method to be carried out by the container cleaning apparatus will be described hereafter. Referring to FIG. 3, two containers C are mounted on the container receiving device 3, the transfer lever 19 is turned to transfer the two containers C from the container receiving device 3 to the container support device 20. The conveyor 4 is driven for intermittent movement to move each container support device 20 supporting the two containers C thereon into the solvent cleaning unit S. The actuators 51 operate automatically and turn the shutters 24 closing the entrance to the solvent cleaning chamber 22 to their open positions to enable the advancement of the containers C into the solvent cleaning chamber 22. After the containers C have been stopped at predetermined positions in the solvent cleaning chamber 22, the actuators 51 operate automatically and turn the shutters 24 to their closed positions to isolate the solvent cleaning chamber 22 from the ambient space. In this state, the shutters 24 disposed between the solvent cleaning unit S and the city water rinsing unit W1 below the solvent cleaning unit S are closed to isolate the solvent cleaning chamber 22 from the city water rinsing unit W1.

Subsequently, the solvent is jetted through the nozzles 39 of the nozzle pipes 38, and the solvent jetting holes of the upright solvent jetting pipes 41 against the outer and the inner surfaces of the containers C supported in an inverted position on the container support device 20 to clean the containers C with the solvent. Since all the shutters 24 are closed during the solvent cleaning operation, the solvent will not be permitted to leak into the city water cleaning unit W1. As mentioned above with reference to FIG. 13, the temperature of the solvent contained in the solvent tank 10 is kept at about 40° C. and the solvent of about 40° C. is jetted against the container C to clean the containers C satisfactorily. The solvent used for cleaning is collected in the solvent sink 26 and is returned to the solvent tank 10.

After the solvent cleaning operation has been completed, the shutters 24 disposed at the entrance to and the exit from the solvent cleaning chamber 22 are turned to their open positions, the conveyor 4 is actuated to convey the cleaned containers C into the rinsing chamber of the city water cleaning unit W1 and, at the same time, to carry containers C to be cleaned into the solvent cleaning chamber 22. After the cleaned containers C have been placed at predetermined rinsing positions and the uncleaned containers C have been placed at the predetermined cleaning positions, the shutters 24 are closed and the uncleaned containers C are subjected to the solvent cleaning operation.

Basically, a city water rinsing operation to be carried out by the city water rinsing unit W1 is identical with the solvent cleaning operation carried out by the solvent cleaning unit S. The city water rinsing unit W1 jets city water heated at about 70° C. against the outer and inner surfaces of the containers C to rinse the water-soluble solvent and foreign matters remaining on the containers C off the containers C. The used city water is drained.

The pure water rinsing unit W2 jets pure water at room temperature contained in the pure water tank 13 against the outer and inner surfaces of the containers for final rinsing.

The drying unit D blows hot air against the containers C first, and then blows air at room temperature against the containers C to dry the containers C.

The present invention uses a water-soluble or partially water-soluble solvent having a flash point of 55° C. or above Possible solvents include alcohols, ketones, fatty acids, esters, amides and various compounds having at least two functional groups.

The alcohols include 1,2-ethanediol and 1,2-propanediol. The ketones include acetonylacetone. The fatty acids include propionic acid and butyric acid. The esters include ethylene carbonate, dimethoxybutylacetate and propylene carbonate. The amides include N,N-dimethylacetoamide. The compound having at least two functional groups include 2-ethoxyethanol, dimethyl sulfoxide, diethylene glycol monomethyl ether, dipropylene glycol monomethyl ether, diethylene glycol, furfuryl alcohol, triethylene glycol monomethyl ether.

The cleaning ability of the solvent is greatly dependent on the temperature of the solvent. The cleaning ability of the solvent increases sharply with the increase of its temperature, which is considered to be due to the decreases of the viscosities of oils adhering to the surface of an article with the rise of temperature of the solvent. However, the cleaning ability of most solvents does not increase infinitely with temperature and stops increasing after the temperature of the solvent has exceeded about 40° C. On the other hand, it is desirable that the temperature of the solvent, particularly a hydrocarbon solvent, when the solvent is used for cleaning is lower by at least about 15° C. than the flash point of the solvent in view of safety because a solvent concentration of 25% of the lower explosion mixture limit or below is attained at a solvent temperature lower by 15° C. or less below the flash point [SAISHIN SENJO GIJUTSU SORAN (Modern Cleaning Technology Manual), Volume 5: Kogyo-yo Senjouzai oyobi Senjou (Industrial CleaningAgents and Cleaning), Chapter 1: Kagaku-teki Senjou oyobi Senjou Hoho (Chemical Cleaning and Cleaning Method), Section 1:

Senjou Zai (Cleaning Agents), published by Kabushiki Kaisha Sangyou Gijutsu service center, Japan].

When the solvent is heated at 40° C. to increase the cleaning ability of the solvent, it is necessary that the solvent has a flash point of 55° C. higher by 15° C. than the temperature of the solvent. Accordingly, the present invention uses a solvent having a flash point of 55° C. or above. It is necessary to enable the rinsing process subsequent to the solvent cleaning process to achieve satisfactory rinsing that the solvent is at least partially water-soluble.

According to fire protection guidance by the government, explosion-proof motors and explosion-proof lighting devices must be used in an environment in which an inflammable substance having a flash point below 40° C. is used. However, the prices of explosion-proof devices are about twice those of ordinary devices. Therefore, it is advantageous in view of the equipment costs and safety to use a solvent having a high flash point. The devices of the container cleaning apparatus according to the present invention need not be of an explosion-proof type because the present invention uses a solvent having a flash point of 55° C. or above.

As is apparent from the foregoing description, the container cleaning method according to the present invention cleans containers with a water-soluble or partially water-soluble solvent having a flash point of 55° C. or above in a solvent cleaning chamber isolated from the ambient environment and rinses the solvent-cleaned containers by jetting water against the container in a water rinsing chamber. Therefore, operations for solvent cleaning and rinsing can be automatically carried out, and manual cleaning work and the like in a bad working environment, such as an environment polluted with a volatile solvent, can be eliminated. Since the solvent employed in the container cleaning method of the present invention uses a solvent having a flash point of 55° C. or above, there is no danger of ignition and explosion, and the solvent can be safely jetted in the solvent cleaning chamber, and the solvent can be heated to enhance its cleaning ability. The solvent cleaning ability of the present invention is far higher than manual solvent cleaning ability. Since the solvent is water-soluble or partially water-soluble, the solvent remaining on the containers can be efficiently rinsed off by the water rinsing process subsequent to the solvent cleaning process. Since the components of the container cleaning apparatus need not be of an explosion-proof type, the container cleaning apparatus can be manufactured at a relatively low cost.

The container cleaning apparatus of the present invention has advantages, in addition to an advantage that the solvent cleaning process which jets a solvent can be carried out automatically, that the solvent cleaning chamber can be isolated from the external space and the water rinsing chamber during the solvent cleaning process by the shutters to avoid the leakage of the solvent from the solvent cleaning chamber, and the solvent can be recovered and recirculated. Furthermore, the shutters can be properly retracted to their open positions when conveying containers into and carrying out the same from the solvent cleaning chamber.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A container cleaning apparatus comprising:

a solvent cleaning unit having a solvent cleaning chamber internally provided with solvent jetting means for jetting a water-soluble or partially water-soluble solvent;

a rinsing unit having a rinsing chamber connected to the solvent cleaning chamber and internally provided with rinsing liquid jetting means;

a conveyor extended through the solvent cleaning chamber and the rinsing chamber;

a container support device provided on the conveyor to be conveyed thereby, for supporting containers thereon so that the containers can be cleaned with the water-soluble or partially water-soluble solvent jetted by the solvent jetting means and the containers can be rinsed with rinsing liquid jetted by the rinsing liquid jetting means;

shutter devices having shutters disposed at an entrance to the solvent cleaning chamber and an exit from the solvent cleaning chamber, respectively, so as to be moved between closed positions to close the entrance to and the exit from the solvent cleaning chamber and to isolate the solvent cleaning chamber from the rinsing chamber, and open positions to permit the container support device and the containers supported on the container support device to move from the solvent cleaning chamber to the rinsing chambers, wherein the shutter of each shutter device is supported for turning through an angle of about 90° about a vertical axis between the open position and the closed position, and the open position of the shutter is alongside the conveyor in either the solvent cleaning chamber or the rinsing chamber, wherein the shutter of each shutter device is connected by a swing arm to a drive shaft coaxial with the vertical axis about which the shutter is turned, and the shutter has an outer surface which is a part of a circular cylinder having its center axis coinciding with the vertical axis about which the shutter is turned, and wherein the shutters on both sides disposed at the entrance have outer side edges which come into contact with each side edge of a partition wall disposed at the entrance to the solvent cleaning chamber, respectively, when the shutters on both sides are turned to their closed positions, and the shutters on both sides disposed at the exit have outer side edges which come into contact with each side edge of a partition wall disposed at the exit from the solvent cleaning chamber, respectively, when the shutters on both sides are turned to their closed position.

* * * * *